US007326307B2

(12) United States Patent
Ueta et al.

(10) Patent No.: US 7,326,307 B2
(45) Date of Patent: Feb. 5, 2008

(54) THERMAL FATIGUE RESISTANT CAST STEEL

(75) Inventors: Shigeki Ueta, Nagoya (JP); Shuji Hamano, Nagoya (JP); Toshiharu Noda, Nagoya (JP)

(73) Assignee: Daido Steel Co., Ltd., Aichi-ken (JP)

( * ) Notice: Subject to any disclaimer, the term of this patent is extended or adjusted under 35 U.S.C. 154(b) by 643 days.

(21) Appl. No.: 10/395,236

(22) Filed: Mar. 25, 2003

(65) Prior Publication Data

US 2003/0188808 A1 Oct. 9, 2003

(30) Foreign Application Priority Data

Mar. 26, 2002 (JP) ..... 2002-086517

(51) Int. Cl.
*C22C 38/48* (2006.01)

(52) U.S. Cl. ..... 148/327

(58) Field of Classification Search ..... 148/327, 148/419, 326, 320

See application file for complete search history.

(56) References Cited

FOREIGN PATENT DOCUMENTS

JP 58-217663 * 12/1983

OTHER PUBLICATIONS

Key To Steel, 10th Edition 1974, Verlag Stahlschlussel, ,West Germany.*

English Translation of JP 58-217663, "Cast Alloy for Guide Shoe", May 2006.*

* cited by examiner

*Primary Examiner*—Roy King
*Assistant Examiner*—Kathleen McNelis
(74) *Attorney, Agent, or Firm*—Posz Law Group, PLC; R. Eugene Varndell, Jr.

(57) ABSTRACT

Disclosed is a heat resistant cast steel having not only good heat resistance but also good thermal fatigue resistance, which is suitable as the material for engine parts, particularly, such as exhaust gas manifold and turbo-housing, which are repeatedly exposed to such a high temperature as 900° C. or higher. The heat resistant cast steel comprises, by weight percent, C: 0.2-1.0%, Ni: 8.0-45.0%, Cr: 15.0-30.0%, W: up to 10% and Nb: 0.5-3.0%, provided that [%C]-0.13[%Nb]: 0.05-0.95%, the balance being Fe and inevitable impurities, and the cast structure contains dispersed therein, by atomic percent, MC-type carbides: 0.5-3.0% and $M_{23}C_6$-type carbides: 0.5-10.0%. The matrix of the steel is an austenitic phase mainly composed of Fe—Ni—Cr and the steel has the mean coefficient of thermal expansion in the range from room temperature to 1050° C. up to $20.0\times10^{-4}$ and a tensile strength in the temperature range up to 1050° C. 50 MPa or higher.

5 Claims, No Drawings

THERMAL FATIGUE RESISTANT CAST STEEL

BACKGROUND OF THE INVENTION

1. Technical Field

The present invention concerns heat resistant cast steels having good thermal fatigue resistance. The heat resistant cast steel of the invention is suitable as the material for the engine parts, for example, exhaust manifolds and turbo-housings, which are used under the conditions where the part is repeatedly heated to such a high temperature as 900° C. or higher.

2. Prior Art

To date, ductile cast iron has been used as the material for the above-mentioned engine exhaust parts to which good thermal fatigue resistance is required. For the parts which are exposed to particularly high temperature exhaust gas Niresist cast iron and ferritic stainless cast steel have been used. Recently, since regulations against the exhaust gas has been getting more severe, necessitates increase in combustion efficiency of the engines, and thus, temperature of the exhaust gas is going to so high as 900° C. or higher. Therefore, austenitic stainless cast steel has been used in some fields of parts, though it has a coefficient of thermal expansion higher than that of the ferritic materials and thus, disadvantageous from the view point of thermal fatigue resistance, due to the high strength at a temperature higher than 900° C.

Known inventions concerning austenitic heat resisting cast steel are disclosed in, for example, Japanese Patent Disclosure S. 50-87916 and S. 54-58616. These steels were, however, developed for the purpose of improving high temperature strength without paying consideration on the thermal fatigue, and there has been demand for better heat resisting cast steel in regard to the thermal fatigue resistance. In order to improve the thermal fatigue resistance of the cast steel it is necessary to realize not only increase in the high temperature strength but also decrease in the coefficient of thermal expansion.

The inventors made research on Fe—Ni—Cr—W—Nb—Si—C—based cast steel and found the following relation concerning the influence of contents of the alloy components on the mean coefficient of thermal expansion the formulae of the chemical symbols contents in matrix are in weight percent, and [MC] and [$M_{23}C_6$] are in atomic percent):

1) Tensile strength at 1050° C.

$$\sigma_{TS\ at\ 1050^\circ C.}(MPa)=68.73-11.82Si+9.35[MC]+4.38[M_{23}C_6]$$

2) Mean coefficient of thermal expansion in the temperature range from room temperature to 1050° C.

$$\alpha_{Rt-1050^\circ C.}\times10^{-4}(1/^\circ C.)=21.281-0.046Ni-0.044Cr-0.135W+1.656Nb-0.192[MC]-0.082[M_{23}C_6]$$

It has been found that MC- and $M_{23}C_6$-type carbides have important influence on increase of the high temperature strength and decrease of the coefficient of thermal expansion. Further, it has been found that tungsten is used not only to contribute to the high temperature strength of the austenitic cast steel, but also to decrease in the coefficient of thermal expansion.

As the results of further research the inventors ascertained that "M" of the MC-type carbide is mainly Nb and "M" of the $M_{23}C_6$-type carbide is mainly Cr and W, and found that formation of MC-type carbide by Nb is useful for increase in the high temperature strength and decease in the coefficient of thermal expansion, while Nb in the matrix has negative effect. If the addition amount of MC-type carbide-forming element such as Nb is excess to C-content, formation of MC-type carbides is easier than that of $M_{23}C_6$-type carbides. Then, $M_{23}C_6$-type carbides will not be formed and the matrix contains excess Nb, which will rather result in decrease of high temperature strength and increase of thermal expansion coefficient. In the conventional austenitic heat resistant steel it has been a tendency to add excess amount of Nb, and the added Nb forms the MC-type carbide. It is the inventors' conclusion that it is advisable to have not only the MC-type carbides formed but also the $M_{23}C_6$-type carbides necessarily formed.

The inventors then experienced that, upon carrying out thermal fatigue tests according to JIS Z 2278 in which the samples are subjected to repeated heat cycle of 1050° C. to 150° C., significant cracks occur in cast steels having mean coefficients of thermal expansion from room temperature to 1050° C. exceeding $20.0\times10^{-4}$ and tensile strength lower than 50 MPa, particularly, cast steels having 0.2%-proof stress lower than 30 MPa, and further test can no longer be continued. Thus, it is concluded that, in order to achieve sufficient thermal fatigue lives, the steel must have a mean coefficient of thermal expansion in the range from room temperature to 1050° C. not higher than $20.0\times10^{-4}$ and a tensile strength in the temperature range up to 1050° C. 50 MPa or higher.

SUMMARY OF THE INVENTION

The object of the present invention is to utilize the above-explained discovery by the inventors and to provide a heat resisting steel having a good thermal fatigue resistance suitable as the material for the engine parts which are repeatedly heated to such a high temperature as 900° C. or higher.

The heat resistant steel having good thermal fatigue resistance according to the invention is characterized in that the steel structure contains in the form of dispersion therein, in atomic percentage, MC-type carbides 0.5-3.0% and $M_{23}C_6$-type carbides 5-10%, that the matrix consists essentially of an austenitic phase mainly composed of Fe—Ni—Cr, and a mean coefficient of thermal expansion in the range from room temperature to 1050° C. up to $20.0\times10^{-4}$ and a tensile strength in the temperature range up to 1050° C. 50 MPa or higher.

DETAILED EXPLANATION OF THE PREFERRED EMBODIMENTS

Composition of the heat resisting cast steel having a good thermal fatigue resistance according to the present invention is, in weight %, C: 0.2-1.0%, Ni: 8.0-45.0%, Cr: 15.0-30.0%, W: up to 10% and Nb: 0.5-3.0%, provided that [C-0.13Nb]: 0.05-0.95%, and the balance being Fe and inevitable impurities. It is of course essential that the steel consists of the matrix in which the above-mentioned carbides exist, and that the steel has the above-mentioned mean coefficient of thermal expansion and the above-mentioned tensile strength.

The heat resistant cast steel having a good thermal fatigue resistance according to the invention may optionally contain, in addition to the above-described basic alloy composition, one or more of the components belonging to the following groups:

1) one or both elements of the group consisting of Si: 0.1-2.0% and Mn: 0.1-2.0%;

2) one or both elements of the group consisting of S: 0.05-0.2% and Se: 0.001-0.50%;

3) one or more elements of the group consisting of Mo: up to 5.0%, Ti: up to 1.0%, Ta: up to 1.0% and Zr: up to 1.0%, provided that [%C]-0.13[%Nb]-0.25[%Ti]-0.13[%Zr]-0.07 [%Ta]: 0.05-0.95%; and 4) one or more elements of the group consisting of B: 0.001-0.01%, N: 0.01-0.3% and Ca: up to 0.10%.

The above-mentioned conditions concerning the carbides, i.e., in atomic %, MC-type carbides: 0.5-3.0% and M23C6-type carbides 0.5-10%, have the following significance:

As noted above, "M" of the MC-type carbides are mainly Nb, Ti and Ta, and "M" of the $M_{23}C_6$-type carbides are mainly Cr and W, and in addition to them, Mo. These types of carbides are useful for improving high temperature strength and, due to the low thermal expansion of the carbides, effective to lower the thermal expansion of whole the system. These effects may not be obtained with such small contents less than 0.5% of both the carbides. On the other hand, excess carbides, i.e., 3.0% or more to the MC-type carbides and 10% or more to the $M_{23}C_6$-type carbides, may decrease ductility of the steel, which will result in decreased thermal fatigue resistance. It is necessary to have both the kinds of carbides formed.

The reasons why the above-described alloy composition is chosen are as follows:

C: 0.2-1.0%

Carbon combines with niobium and tungsten to form their carbides, which increase the high temperature strength and lower the thermal expansion of the steel, and thus, effective to improve the thermal fatigue resistance. The effects can be given by existence of at least 0.2% of carbon. Excess addition of carbon will lower the ductility of the steel and give a negative effect on the thermal fatigue resistance, and therefore, addition of C must be limited to up to 1.0%.

Ni: 8.0-45.0%

Nickel is an element stabilizing the austenitic phase in the matrix and enhancing heat resisting and oxidation resisting properties. It also decreases the thermal expansion of the steel. In order to ensure these effects it is necessary to add at least 8.0% of nickel. At a larger amount of addition the effects will saturate and the costs will increase. Thus, 45.0% is the maximum amount of addition of nickel.

Cr: 15.0-30.0%

Chromium combines with carbon to form mainly $M_{23}C_6$-type carbide, which is useful for increasing the high temperature strength and decreasing the thermal expansion. Chromium in the matrix phase enhances the oxidation resistance and the heat resistance of the steel. These effects are ensured by addition of chromium of at least 15.0%. Addition exceeding 30.0% causes formation of σ-phase, which is an embrittlement phase, and decreases the thermal fatigue resistance and oxidation resistance.

W: up to 10%

Tungsten combines with carbon to form mainly $M_{23}C_6$-type carbide, which is useful for increase of the high temperature strength and decrease of the thermal expansion. In case where tungsten is contained in the matrix phase, it is quite effective for decrease in the thermal expansion. Excess addition not only heightens the manufacturing costs but also increases possibility of μ-phase formation, which is also an embrittlement phase, and thus, decreases the thermal fatigue resistance. As the maximum amount of addition 10% is set.

Nb: 0.5-3.0%, Provided That [5C]-0.13[%Nb]: 0.05-0.95%

Niobium combines with carbon to form, as noted above, mainly MC-type carbides, which will be useful for increase of the high temperature strength and decrease of the thermal expansion. To expect these effects at least 3% of addition is required. Addition in an excess amount will decrease the ductility of the steel, and 3% is the upper limit of addition. The relation between Nb-content and C-content is important. As discussed above, addition of Nb in an amount excess relative to C-content which is necessary for forming the MC-type carbide causes containment of niobium in the matrix phase. This will cause decrease of the high temperature strength and increase of the thermal expansion, and as the result, thermal fatigue resistance will be damaged. Therefore, it is essential to choose the amount of [%C]-0.13[%Nb] in the range of 0.05-0.95%.

The roles of the optionally added alloying element or elements and the reasons for limiting the alloy composition are as follows:

Si: 0.1-2.0%

Silicon improves oxidation resistance of the steel and fluidity of the molten steel. If such improvement is desired, it is advisable to add silicon. The above effects may be obtained by addition of 0.1% or more of silicon. As understood from the above formula 1), however, silicon decreases the high temperature strength of the steel, and therefore, addition in a too large amount should not be done. The upper limit is 2.0%.

Mn: 0.1-2.0%

Manganese is effective as the deoxidizing agent of the steel, and combines with sulfur and selenium to form inclusions, which improve machinability of the steel. These effects may be obtained at addition of 0.1% or so. This level of content is popular in ordinary steel due to the raw material. Too much addition decreases the oxidation resistance of the steel, and thus, addition up to 2% is recommended.

One or Both of S: 0.005-0.20% and Se: 0.001-0.50%

Both sulfur and selenium combine with manganese to form MnS and MnSe, which are useful for improving machinability of the steel. The effect may be obtained by addition in the amount of the respective lower limits, 0.05% for S and 0.001% for Se. Excess addition more than the respective upper limits, 0.20% for S and 0.50% for Se, will lower the ductility of the steel and damages the thermal fatigue resistance.

Mo: Up to 5.0%

Molybdenum combines, like tungsten, with carbon to form the $M_{23}C_6$-type carbides. Excess addition increases the manufacturing costs and decreases the oxidation resistance.

One or more of Ti, Ta and Zr: up to 1.0%, provided that [%C]-0.13[%Nb]-0.25[%Ti]-0.13[%Zr]-0.07[%Ta]:0.05-0.95%

These elements combine, like niobium, with carbon to form MC-type carbides. Because excess addition of these elements decreases the ductility of the steel, addition amount must be up to 1.0%. Existence of these elements in the matrix phase is not preferable as in the case of niobium, and the amounts of these elements should be in the range defined by the above formula.

B: 0.001-0.01%

Boron makes the carbide particles fine and increases the high temperature strength of the steel. This effect can be appreciated at such a small amount of addition as 0.001%.

Addition of a large amount of boron results in precipitation of borides at the grain boundaries. This weakens the grain boundaries and decreases the high temperature strength. Thus, addition amount should not exceed 0.01%.

N: 0.01-0.3%

Nitrogen stabilizes the austenitic phase of the steel. It also suppresses coarsening of the carbides particles and is effective for preventing decrease in the thermal fatigue resistance. The effect will be observed at a low content of 0.01% or so. A large amount of nitrogen forms nitrides, which decrease the ductility of the steel. Addition amount must be thus not more than 0.3%.

Ca: up to 0.10%

Calcium forms an oxide, which improves the machinability of the steel. Addition in a large amount will decrease the ductility of the steel, and therefore, addition is limited to be 0.10% or less.

The heat resistant cast steel according to the present invention has not only good heat resistance but also good thermal fatigue resistance. The latter is recognized by high durability to repeated tests of temperature changes from a high temperature exceeding 900° C. to a low temperature near the room temperature. Thus, the present heat resistant cast steel is the most suitable as the material for the parts such as exhaust manifold and turbo-housing of automobile engines. It is expected that the parts made of this material will have durability better than those made of the conventional materials.

EXAMPLES

Heat resisting steels of the alloy compositions shown in Table 1 (examples) and Table 2 (control examples) were produced in an induction furnace. In the Tables the amount of the carbides are shown in atomic %, the alloying components in weight %, and the balance is Fe. "X" in the Tables stands for the values of [%C]-0.13[%Nb]-0.25[%Ti]-0.13[%Zr]-0.07[%Ta]. The molten steels were cast into "A-type" boat-shaped ingots according to JIS H5701 and disk-shaped specimens of outer diameter 65 mm, base diameter 31 mm and thickness 15 mm with an edge angle of 300.

The ingots were heated at 1100° C. for 30 minutes to anneal. From the boat-shaped ingots, test pieces were cut out in the direction lateral to columnar grain to prepare for high temperature tensile tests and measurements of mean coefficient thermal expansion. The tests and measurements were carried out as follows:

[High Temperature Tensile Test]

Distance of the gauze marks: 30 mm,
Length of parallel parts: 6 mm,
Measurement: at 1050° C.

[Thermal Expansion Coefficient Measurement]

Measurement of thermal expansion was carried out in a differential expansion analyzer using alumina as the standard sample. Rate of temperature elevation was 10° C./min. and the measured values of thermal expansion were averaged in the range from room temperature to 1050° C.

The disk-shaped cast specimens were machined to thermal fatigue test pieces having outer diameter 60 mm, base diameter 25.6 mm, thickness 10 mm and edge angle 300, which were subjected to the following thermal fatigue test, and the crack length occurred at the edges of the test pieces were measured.

[Thermal Fatigue Test]

In accordance with JIS Z2278, the test pieces were subjected to the thermal cycles consisting of immersion in a high temperature fluidized bed at 1050° C. for 3 minutes and subsequent immersion in a low temperature fluidized bed at 150° C. for 4 minutes, which were repeated for 200 times.

The results are shown in Table 3 (Examples) and Table 4 (Control Examples).

TABLE 1

Examples

| No. | C | Si | Mn | S, Se | Cr | Ni | W | Mo | Nb | Ti, Ta, Zr | B, N, Ca | X | MC | $M_{23}C_6$ |
|---|---|---|---|---|---|---|---|---|---|---|---|---|---|---|
| A | 0.21 | — | — | — | 25.2 | 29.9 | 4.1 | — | 0.8 | — | — | 0.11 | 0.98 | 2.44 |
| B | 0.30 | — | — | — | 28.1 | 35.6 | 0.1 | — | 1.6 | — | — | 0.09 | 1.91 | 2.08 |
| C | 0.42 | 0.8 | 0.5 | — | 18.8 | 9.7 | 8.5 | — | 1.2 | — | — | 0.26 | 1.49 | 6.15 |
| D | 0.33 | 0.6 | 1.2 | S 0.10 | 20.4 | 16.3 | 2.0 | 0.8 | 1.4 | — | — | 0.15 | 1.68 | 3.34 |
| E | 0.29 | 0.8 | 0.9 | — | 25.5 | 40.5 | 6.2 | — | 0.8 | Ti 0.4 | — | 0.09 | 1.95 | 2.00 |
| F | 0.24 | 0.9 | — | — | 21.3 | 20.0 | 1.4 | 0.4 | 0.7 | Ta 0.2<br>Zr 0.3 | — | 0.10 | 1.32 | 2.16 |
| G | 0.87 | 1.7 | 1.5 | S 0.16<br>Se 0.002 | 21.3 | 20.0 | 1.4 | — | 0.7 | Ta 0.2<br>Zr 0.3 | — | 0.65 | 1.96 | 14.14 |
| H | 0.26 | 0.9 | 0.9 | S 0.09<br>Se 0.001 | 20.9 | 26.1 | 3.2 | — | 1.1 | Ti 0.1 | B 0.003 | 0.13 | 1.20 | 2.97 |
| I | 0.30 | 1.0 | 0.7 | S 0.06 | 24.6 | 33.7 | 7.6 | — | 1.1 | Ti 0.1<br>Ta 0.2 | N 0.08<br>Ca 0.003 | 0.13 | 1.61 | 3.08 |
| J | 0.29 | 0.9 | 1.3 | — | 19.8 | 27.5 | 3.1 | — | 0.9 | — | B 0.002<br>Ca 0.002 | 0.12 | 1.58 | 2.73 |
| K | 0.33 | 1.0 | 0.6 | S 0.07<br>Se 0.012 | 22.0 | 38.8 | 5.9 | — | 1.5 | Ti 0.1 | N 0.10 | 0.10 | 2.21 | 2.25 |

TABLE 2

Control Examples

| No. | C | Si | Mn | S, Se | Cr | Ni | W | Mo | Nb | Ti, Ta, Zr | B, N, Ca | X | MC | $M_{23}C_6$ |
|---|---|---|---|---|---|---|---|---|---|---|---|---|---|---|
| 1 | 0.22 | — | — | S 0.06<br>Se 0.002 | 25.6 | 30.2 | 2.2 | — | 1.5 | — | — | 0.03 | 1.82 | 0.59 |
| 2 | 0.63 | — | — | S 0.08<br>Se 0.003 | 21.4 | 25.6 | 1.8 | — | 5.2 | Zr 0.2 | — | −0.07 | 6.54 | 0.00 |

TABLE 2-continued

| | | | | | | | | | | | | | | | |
|---|---|---|---|---|---|---|---|---|---|---|---|---|---|---|---|
| | | | | | | Control Examples | | | | | | | | | |
| No. | C | Si | Mn | S, Se | Cr | Ni | W | Mo | Nb | Ti, Ta, Zr | B, N, Ca | X | MC | $M_{23}C_6$ |
| 3 | 0.25 | 3.5 | 1.4 | S 0.11 | 20.8 | 30.7 | 1.5 | — | 1.3 | — | — | 0.08 | 1.52 | 1.79 |
| 4 | 0.12 | 0.8 | 0.5 | — | 24.9 | 26.8 | 2.3 | — | 0.3 | — | — | 0.08 | 0.36 | 1.82 |
| 5 | 0.30 | 1.1 | 0.9 | S 0.06<br>Se 0.005 | 22.7 | 32.5 | 2.1 | — | 0.2 | — | — | 0.27 | 0.24 | 6.11 |
| 6 | 1.23 | 0.7 | 0.9 | S 0.13 | 29.5 | 38.9 | 8.2 | — | 1.6 | — | — | 1.02 | 1.94 | 23.17 |

TABLE 3

| | | | |
|---|---|---|---|
| | | Examples | |
| Alloy | Tensile Strength (MPa) | Mean Thermal Expansion Coeff. ($\times 10^{-6}$/° C.) | Thermal Fatigue Test Total Crack Length (mm) |
| A | 77 | 18.8 | 92 |
| B | 86 | 19.2 | 81 |
| C | 79 | 19.7 | 92 |
| D | 76 | 19.7 | 90 |
| E | 64 | 18.2 | 82 |
| F | 61 | 19.4 | 97 |
| G | 104 | 19.3 | 76 |
| H | 63 | 19.1 | 86 |
| I | 61 | 18.6 | 82 |
| J | 65 | 19.2 | 85 |
| K | 67 | 18.9 | 80 |

TABLE 4

| | | | |
|---|---|---|---|
| | | Control Examples | |
| Alloy | Tensile Strength (MPa) | Mean Thermal Expansion Coeff. ($\times 10^{-6}$/° C.) | Thermal Fatigue Test Total Crack Length (mm) |
| 1 | 78 | 20.2 | 114 |
| 2 | 121 | 23.2 | 122 |
| 3 | 14 | 20.4 | 135 |
| 4 | 47 | 18.7 | 151 |
| 5 | 62 | 18.4 | 110 |
| 6 | 142 | 17.1 | 118 |

Tensile Strength: measured at 1050° C.

Mean Thermal Expansion Coefficient: from room temperature to 1050° C.

Thermal Fatigue Test: Total crack length after 200 cycles of 1050° C.-150° C.

From the data in Table 1 to Table 4 the following conclusions are given. In Control Example 1, where the value of "X" is less than the lower limit, 0.05%, the measured coefficient of thermal expansion exceeds $20\times10^{-4}$ and the total crack length is large. In the control example 2, where the value "X" is minus, all the carbides are of MC-type and include no $M_{23}C_6$-type, and thus, the demerits of control example 1 is more significant in control example 2. On the other hand, control example 6, where the amount of $M_{23}C_6$-type carbide is too large, though the target values of the tensile strength and the thermal expansion coefficient are achieved, crack formation is significant. Control Example 3, where Si-content is too large, tensile strength is quite dissatisfactory. Control Example 4, where the C-content is smaller than the required, the tensile strength is low and the crack occurs remarkably. Control Example 5 with insufficient amount of Nb is dissatisfactory because of heavy crack formation.

Contrary to them, Example A to Example K, satisfying the conditions defined by the present invention, achieve the target values of the tensile strength and the coefficient of thermal expansion, and obtained improved thermal fatigue resistance.

We claim:

1. A heat resistant cast steel having good thermal fatigue resistance, consisting essentially of, in weight percent, C: 0.2-0.42%, Ni: 8.0-45.0%, Cr: 15.0-30.0%, W: up to 10% and Nb: 0.5-3.0%, provided that [%C]-0.13[%Nb] is in the range of 0.05-0.95%, and the balance being Fe and inevitable impurities, contents of carbides in the steel being, in atomic percent, MC carbides 0.5-3.0% and $M_{23}C_6$ carbides 0.5-10%, the matrix consisting essentially of an austenitic phase mainly composed of Fe—Ni—Cr, mean coefficient of thermal expansion in the range from room temperature to 1050° C. being up to $20.0\times10^{-4}$, and tensile strength in the temperature range up to 1050° C. being 50 MPa or higher.

2. The heat resistant cast steel according to claim 1, wherein the steel further consists the essentially of one or both of Si: 0.1-2.0% and Mn: 0.1-2.0%.

3. The heat resistant cast steel according to claim 1, wherein the steel further consists the essentially of one or both of S: 0.05-0.2% and Se: 0.001-0.50%.

4. The heat resistant cast steel according to claim 1, wherein the steel further consists the essentially of one or more of Mo: up to 5.0%, Ti: up to 1.0%, Ta: up to 1.0% and Zr: up to 1.0%, provided that [%C]-0.13[%Nb]-0.25[%Ti]-0.13[%Zr]-0.07[%Ta] is in the range of 0.05-0.95%.

5. The heat resistant cast steel according to claim 1, wherein the steel further consists the essentially of one or more of B: 0.00 1-0.01%, N: 0.01-0.3% and Ca: up to 0.10%.

* * * * *